US008450034B2

(12) United States Patent
Yumita et al.

(10) Patent No.: US 8,450,034 B2
(45) Date of Patent: May 28, 2013

(54) ELECTROPHOTOGRAPHIC PHOTORECEPTOR, IMAGE FORMING METHOD AND IMAGE FORMING APPARATUS

(75) Inventors: Masanori Yumita, Tokyo (JP); Toyoko Shibata, Kanagawa (JP); Shinichi Hamaguchi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 249 days.

(21) Appl. No.: 12/959,964

(22) Filed: Dec. 3, 2010

(65) Prior Publication Data

US 2011/0151364 A1 Jun. 23, 2011

(30) Foreign Application Priority Data

Dec. 18, 2009 (JP) ..... 2009-287399

(51) Int. Cl.
*G03G 5/00* (2006.01)

(52) U.S. Cl.
USPC .... 430/59.1; 430/56; 430/58.65; 430/123.43; 399/159

(58) Field of Classification Search
USPC ..... 430/59.1, 56, 58.65, 123.43; 399/159
See application file for complete search history.

(56) References Cited

U.S. PATENT DOCUMENTS

2007/0111121 A1* 5/2007 Kikuchi et al. ..... 430/58.65

FOREIGN PATENT DOCUMENTS

| | | |
|---|---|---|
| JP | 63-278065 | 11/1988 |
| JP | 7-261424 | 10/1995 |
| JP | 2006-104183 | 4/2006 |

*Primary Examiner* — Mark A Chapman
(74) *Attorney, Agent, or Firm* — Lucas & Mercanti, LLP

(57) ABSTRACT

Provided is an electrophotographic photoreceptor exhibiting not only excellent durability together with high sensitivity but also excellent image reproduction, which is suitable for an image forming method by which imagewise exposure is performed employing a light source having an emission wavelength peak being in the range of 350-500 nm to form a high density electrostatic latent image on a photoreceptor, and also provided are an image forming method employing the electrophotographic photoreceptor, and an image forming apparatus thereof. Also disclosed is an electrophotographic photoreceptor possessing a conductive support and provided thereon, a charge generation layer and a charge transport layer, wherein the charge generation layer possesses a pyranthrone pigment, and the charge transport layer possesses at least one of compounds represented by Formula (1) or Formula (2) described below:

Formula (1)
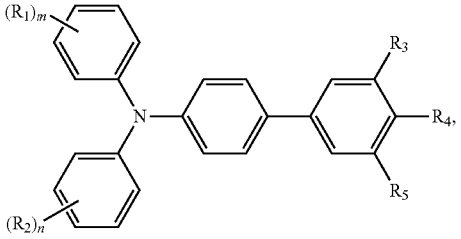
Formula (2)
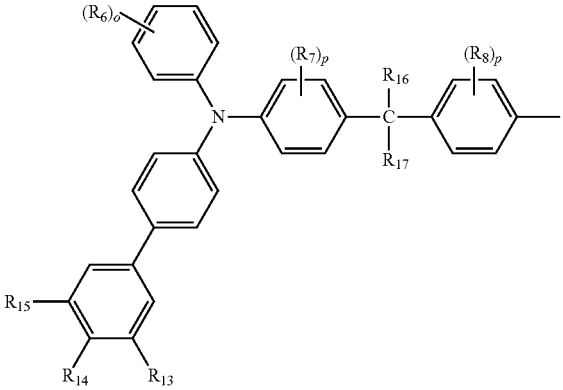
-continued
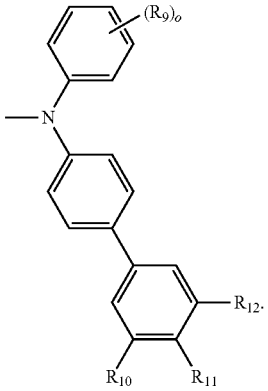
19 Claims, 2 Drawing Sheets

ELECTROPHOTOGRAPHIC PHOTORECEPTOR, IMAGE FORMING METHOD AND IMAGE FORMING APPARATUS

This application claims priority from Japanese Patent Application No. 2009-287399 filed on Dec. 18, 2009, which is incorporated hereinto by reference.

TECHNICAL FIELD

The present invention relates to an electrophotographic photoreceptor used for electrophotographic image formation (hereinafter, referred to simply as a photoreceptor or also as an organic photoreceptor), and further specifically to an electrophotographic photoreceptor, an image forming method and an image forming apparatus used for electrophotographic image formation, which are utilized in the field of copiers and printers.

BACKGROUND

In recent years, opportunities to use an electrophotographic copier and a printer have been increased in the field of printing as well as color printing. In the field of printing as well as color printing, high quality digital monochromatic or color images tend to be demanded. In order to respond to such a demand, it is proposed that a laser light having a short wavelength is employed as a source for exposure to light to form high definition digital images (refer to Patent Document 1).

However, the electrophotographic image quality finally obtained is not always a sufficiently high image quality, even though the laser light having a short wavelength is simply employed, and the dot size of exposure is narrowed to form a minute electrostatic latent image on the electrophotographic photoreceptor.

The reason is that photosensitive properties of the electrophotographic photoreceptor, an electrification characteristic of toner in a developer and so forth do not satisfy properties desired for formation of minute dot latent images as well as formation of toner images.

That is, in cases where the electrophotographic photoreceptor is an electrophotographic photoreceptor developed for a conventional long wavelength laser, (hereinafter, also referred to simply as a photoreceptor), reproducibility of dot images is not sufficient since a sensitivity characteristic is degraded, and no clear dot latent image is formed, when imagewise exposure in which the dot size of exposure is narrowed is conducted with laser light having a short wavelength.

On the other hand, as to an electrophotographic photoreceptor, a function-separation type electrophotographic photoreceptor in which a charge generation layer and a charge transport layer are layered in order to satisfy a photosensitive property, a mechanical property and so forth, that is, an organic photoreceptor in which an organic compound is used as charge generation layer (CGM) and charge transport layer (CTM) tends to be employed.

In this case, there appeared a problem such that the charge transport material for charge transport layer, having been developed for a conventional photoreceptor was easy to absorb light exhibiting a short wavelength of 300-500 nm, whereby degradation of electrophotographic characteristics such as drop in sensitivity drop, rise in residual potential, generation in transfer memory and so forth was produced.

In order to solve such a problem, a charge transport material having a triphenyl amine structure or the like, for example, which exhibits less absorption in the visible light range is known as a charge transport material for a photoreceptor for light exposure employing laser having a short wavelength (refer to Patent Documents 2, 3 and 4).

However, there appeared another problem such that neither sufficient sensitivity, nor sufficient durability was obtained even though a compound having such a triphenyl amine structure was employed as a charge transport material.

(Patent Document 1) Japanese Patent Open to Public Inspection (O.P.I.) Publication No. 2000-250239

(Patent Document 2) Japanese Patent O.P.I. Publication No. 63-278065

(Patent Document 3) Japanese Patent O.P.I. Publication No. 7-261424

(Patent Document 4) Japanese Patent O.P.I. Publication No. 2006-104183

SUMMARY

It is an object of the present invention to provide an electrophotographic photoreceptor exhibiting not only excellent durability together with high sensitivity but also excellent image reproduction, which is suitable for an image forming method by which imagewise exposure is performed employing a short wavelength semiconductor laser having an emission wavelength peak being in the range of 350-500 nm to form a high density electrostatic latent image on a photoreceptor, and to provide an image forming method employing the electrophotographic photoreceptor, and an image forming apparatus thereof.

The inventors have studied a charge generation layer and a charge transport layer in an electrophotographic photoreceptor by which the above-described problems are overcome. As a result, the inventors have found out that when a pyranthrone pigment is used as a charge generation material in a charge generation layer, an objective of the present invention can be accomplished by utilizing a novel electron transport material which is difficult to absorb light having a short wavelength of 300-500 nm as a charge transport material in a charge transport layer, whereby the present invention has been completed.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
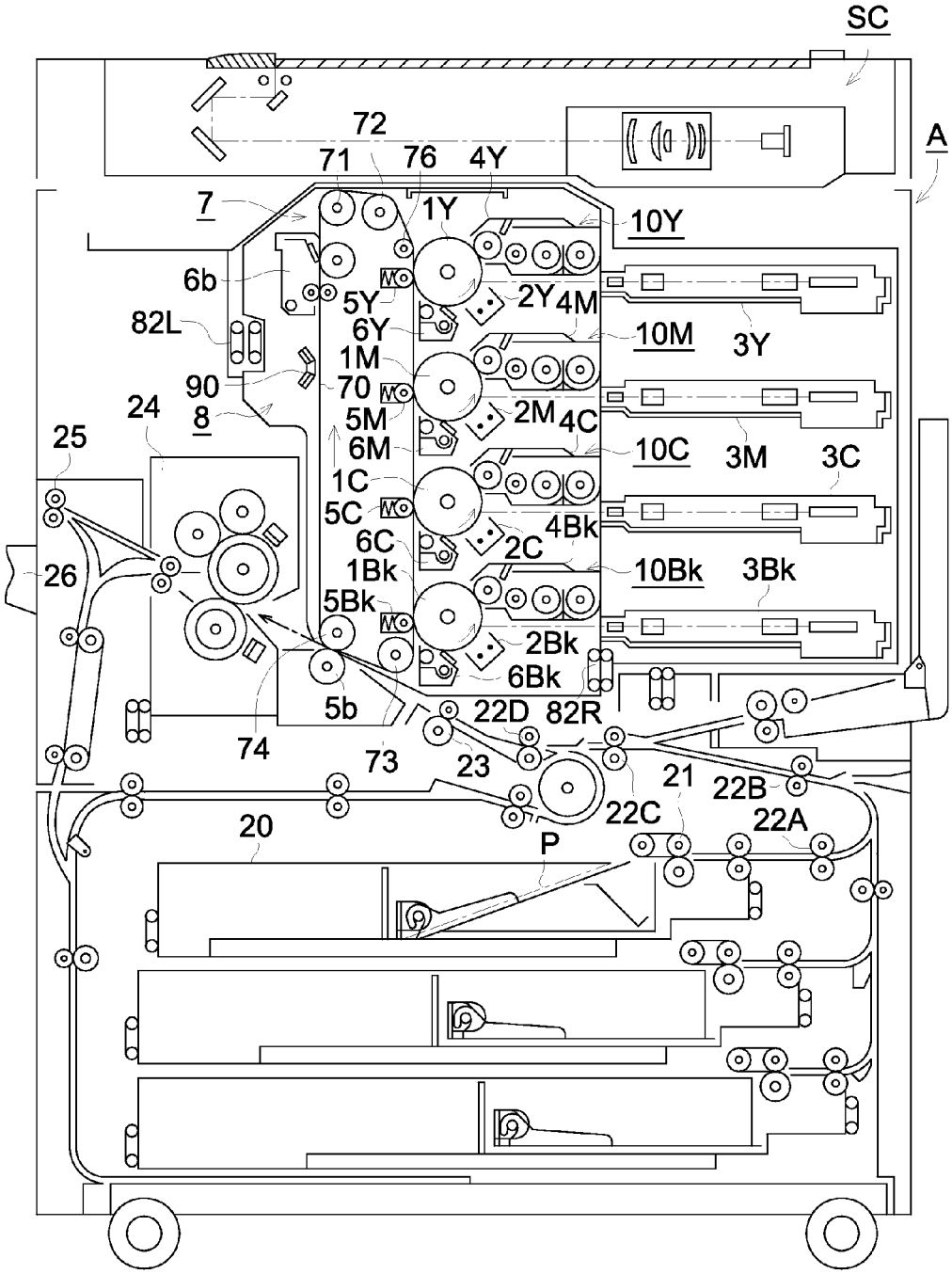
FIG. 1 shows a cross-sectional diagram of a color image forming apparatus in an embodiment of the present invention.

That is, the present invention is accomplished by the following structures.

(Structure 1) An electrophotographic photoreceptor comprising a conductive support and provided thereon, a charge generation layer and a charge transport layer, wherein the charge generation layer comprises a pyranthrone pigment, and the charge transport layer comprises at least one of compounds represented by the following Formula (1) or Formula (2):

Formula (1)

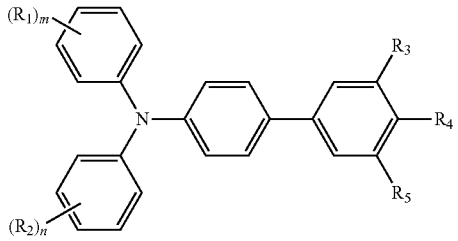

wherein each of $R_1$ and $R_2$ represents an alkyl group having 1-5 carbon atoms, an alkoxy group having 1-5 carbon atoms, or a halogen atom; each of m and n represents an integer of 0-5; and each of $R_3$-$R_5$ represents a hydrogen atom, a substituted or unsubstituted alkyl group having 1-5 carbon atoms, or a substituted or unsubstituted alkoxy group having 1-5 carbon atoms, provided that there is no case for all of $R_3$-$R_5$ being hydrogen atoms, Formula (2)

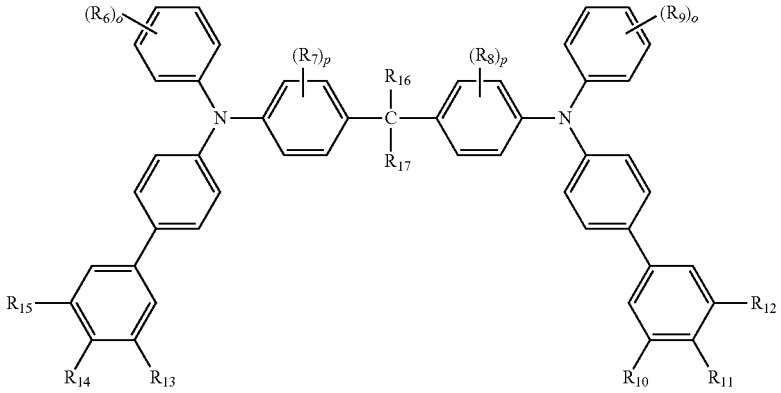

wherein each of $R_6$, $R_9$ represents an alkyl group having 1-5 carbon atoms, an alkoxy group having 1-5 carbon atoms, a halogen atom, an aryl group, a cyano group, a nitro group, or a hydroxyl group; o represents an integer of 0-5 and p represents an integer of 0-4, provided that there is no case for both and p being 0; each of $R_{10}$-$R_{15}$ represents a hydrogen atom, an alkyl group or alkoxy group having 1-5 carbon atoms, a halogen atom, an aryl group, a cyano group, a nitro group, or a hydroxyl group, provided that there is no case for all of $R_{10}$-$R_{15}$ being hydrogen atoms; each of $R_{16}$ and $R_{17}$ represents an alkyl group or an aryl group; and $R_{16}$ and $R_{17}$ may be bonded to form a cyclic structure.

(Structure 2) The electrophotographic photoreceptor of Structure 1, wherein the pyranthrone pigment comprises a compound represented by the following Formula (3):

Formula (3)

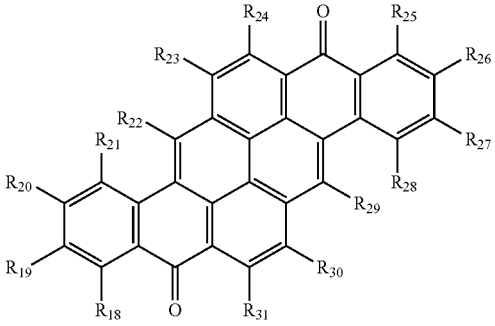

wherein each of $R_{15}$-$R_{31}$ represents a hydrogen atom, an alkyl group, an alkoxy group, an aryl group, a halogen atom, a cyano group, or a nitro group; and at least two selected from the group consisting of $R_{18}$-$R_{21}$ and $R_{25}$-$R_{28}$ may be bonded to constitute at least one of an aromatic ring and a heterocycle.

(Structure 3) An image forming method to form images repeatedly employing an electrophotographic photoreceptor, comprising: a charging step of charging the electrophotographic photoreceptor, a light exposure step of exposing the electrophotographic photoreceptor to light from a light source having an emission wavelength peak being in a range of 350-500 nm to form an electrostatic latent image; and a developing step of developing the electrostatic latent image, wherein the electrophotographic photoreceptor comprises an electrophotographic photoreceptor of Structure 1 or 2.

In addition, the emission wavelength peak means the maximum value clearly disclosed when after light emission is produced from a light source, each light wavelength is taken along the horizontal axis, and light emission intensity is taken along the vertical axis to draw an emission spectrum.

(Structure 4) An image forming apparatus comprising a charging device to charge an electrophotographic photoreceptor, a light exposure device to expose the electrophotographic photoreceptor to light from a light source having an emission wavelength peak being in a range of 350-500 nm in order to form an electrostatic latent image; and a developing device to develop the electrostatic latent image, provided around the electrophotographic photoreceptor, wherein the electrophotographic photoreceptor comprises an electrophotographic photoreceptor of Structure 1 or 2.

(Structure 5) The electrophotographic photoreceptor of Structure 1, wherein $R_4$ represents an alkyl group, and at least one of $R_{11}$ and $R_{14}$ represents an alkyl group.

(Structure 6) The electrophotographic photoreceptor of Structure 2, wherein at least one of $R_{18}$, $R_{19}$, $R_{20}$, $R_{21}$, $R_{25}$ and $R_{28}$ represents a halogen atom.

(Structure 7) The electrophotographic photoreceptor of Structure 6, wherein each of $R_{18}$, $R_{21}$, $R_{25}$ and $R_{28}$ represents a halogen atom.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The structures and effects of the present invention will be further described.

For what reason the above-described effects are obtained is not necessarily clear, but since light having a wavelength of 350-500 nm considerably passes through a charge transport layer containing a compound represented by Formula (1) or Formula (2), it is possibly one of the contributing factors that optical sensitivity of a charge generation material in a charge generation layer situated below is hardly inhibited.

However, in addition, the reason why a photoreceptor containing a compound of the present invention exhibits excellent durability together with high sensitivity and high image quality is presumably as follows.

When a compound represented by Formula (1) or Formula (2) has a biphenyl moiety, it exhibits high fluorescence generation ability. It appears that energy is released via fluorescence emission produced by absorbed light, whereby durability of the compound itself is improved.

In the case of a biphenyl group disclosed in the foregoing Patent Document 4, the absorption wavelength leads to a longer wavelength, and semiconductor laser light having a wavelength of 350-500 nm is absorbed, whereby transfer memory is generated, and the amount of light reaching the charge generation layer is lowered.

Further, since a layer containing an electron transfer material represented by Formula (1) or Formula (2) is compatible with a layer containing another component, it is presumably a factor by which the effect of the present invention is produced that a film exhibiting excellent durability is formed.

In addition, a pyranthrone pigment, specifically a charge generation material represented by Formula (3) is effective, so that hole charge largely and effectively released is caught, and could be transferred onto the surface of a photosensitive layer. In this case, it is assumed that precise reproduction can be made even though an extremely small latent image is provided.

[Charge Transport Material]

The charge transport layer means a layer possessing a function in which charge carrier generated in the charge generation layer via light exposure is transported onto the surface of an organic photoreceptor, and specific detection of the charge transport function can be confirmed by layering the charge generation layer and the charge transport layer on a conductive support to detect photoconductivity.

In the present invention, at least one of compounds represented by Formula (1) or Formula (2) is contained as the charge transport material in the charge transport layer.

First, compounds represented by Formula (1) or Formula (2) will be described.

{Compounds represented by Formula (1)}

In Formula (1), each of $R_1$ and $R_2$ represents an alkyl group having 1-5 carbon atoms, an alkoxy group having 1-5 carbon atoms, or a halogen atom; each of m and n represents an integer of 0-5; and each of $R_3$-$R_5$ represents a hydrogen atom, a substituted or unsubstituted alkyl group having 1-5 carbon atoms, or a substituted or unsubstituted alkoxy group having 1-5 carbon atoms, provided that there is no case for all of $R_3$-$R_5$ being hydrogen atoms. In addition, $R_1$ and $R_2$ may be identical groups to each other, and may be different groups from each other, and $R_3$-$R_5$ may be identical groups to each other, and may be different groups from each other. $R_4$ is preferably an alkyl group having 4 carbon atoms or less, and more preferably is a methyl group. It is still more preferable that each of m and n is an integer of 1, each of $R_1$ and $R_2$ is a methyl group at the 4-position, and $R_4$ is a methyl group.

Specific examples of compounds represented by Formula (1) are exemplified below.

CTM-1

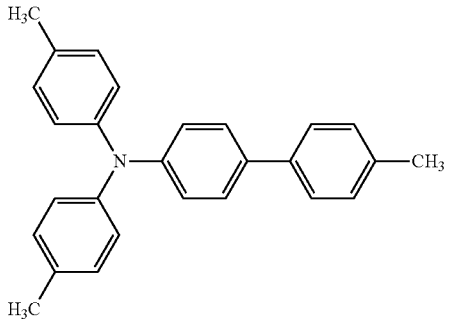

CTM-2

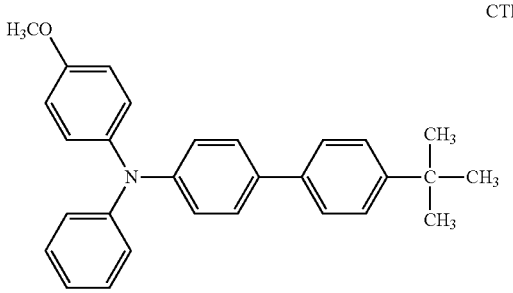

CTM-3

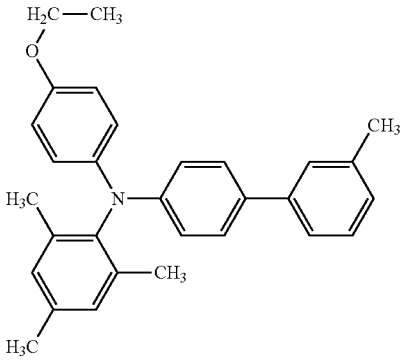

A compound represented by Formula (1) can be synthesized via Ullmann reaction employing diphenylamine and an aryl halide using copper and an alkali as catalyst, or via a Suzuki coupling method using a palladium catalyst.

{Compounds represented by Formula (2)}

In Formula (2), each of $R_6$-$R_9$ represents an alkyl group having 1-5 carbon atoms, an alkoxy group having 1-5 carbon atoms, a halogen atom, an aryl group, a cyano group, a nitro group, or a hydroxyl group. In addition, $R_6$-$R_9$ may be identical groups to each other, and may be different groups from each other.

Further, o represents an integer of 0-5 and p represents an integer of 0-4, provided that there is no case for both o and p being 0; each of $R_{10}$-$R_{15}$ represents a hydrogen atom, an alkyl group or alkoxy group having 1-5 carbon atoms, a halogen atom, an aryl group, a cyano group, a nitro group, or a hydroxyl group; $R_{10}$-$R_{15}$ may be identical groups to each other, and may be different groups from each other, provided that there is no case for all of $R_{10}$-$R_{15}$ being hydrogen atoms; each of $R_{16}$ and $R_{17}$ represents an alkyl group or an aryl group; and $R_{16}$ and $R_{17}$ may be bonded to form a cyclic structure.

Specific examples of compounds represented by Formula (2) are exemplified below.

CTM-4

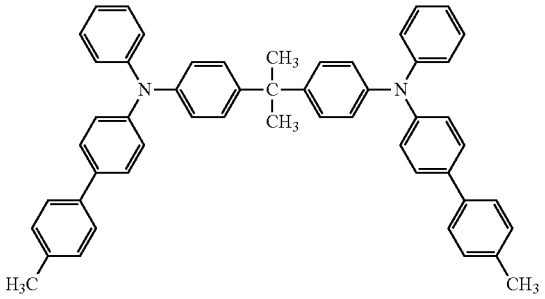

CTM-5

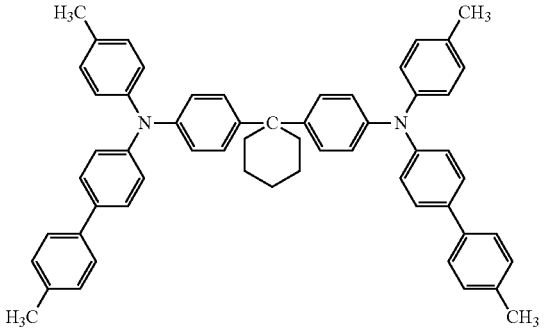

CTM-6

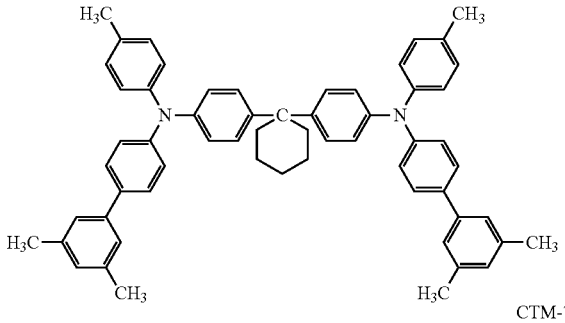

CTM-7

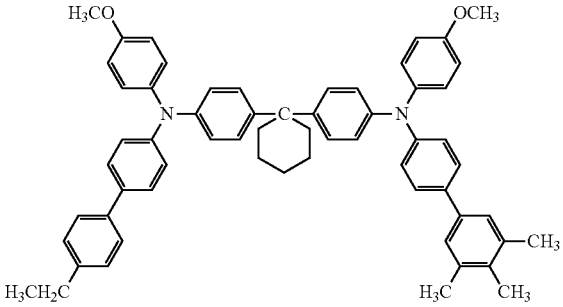

CTM-8

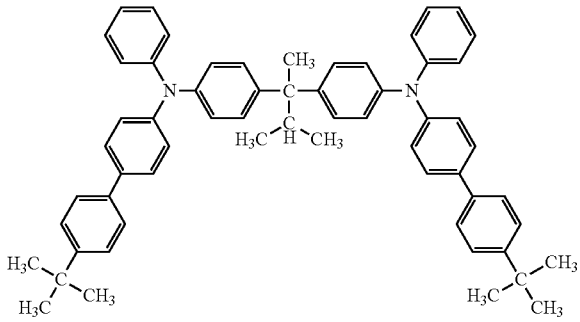

-continued

CTM-9

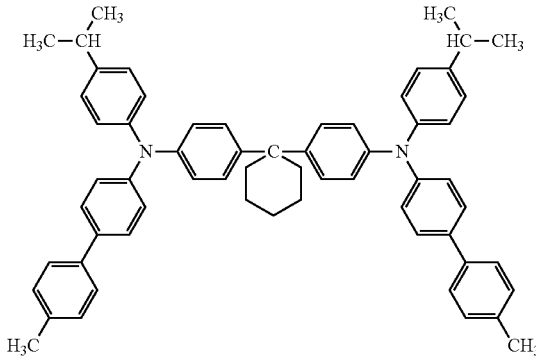

In order to synthesize the compound represented by Formula (2), a triphenylamine having a biphenyl group may be reacted with various ketones using an acid as catalyst.

[Charge Generation Material: Pyranthrone Pigment]

Next, a pyranthrone pigment of the present invention will be described. That is, the pyranthrone pigment is used as a charge generation material in a charge generation layer. Pigments such as a monoazo compound, a disazo compound, a trisazo compound and so forth are commonly known as the charge generation material, but it is extremely preferred that the pyranthrone pigment of the present invention is a pigment as a compound represented by foregoing Formula (3).

Pyranthrone pigment compounds represented by foregoing Formula (3), which are preferably usable in the present invention, are exemplified below.

CGM-1

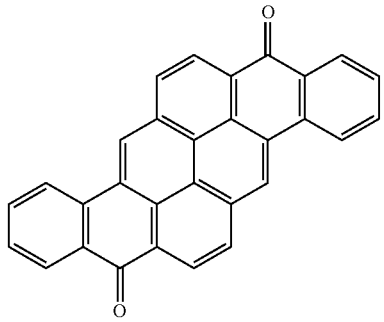

CGM-2

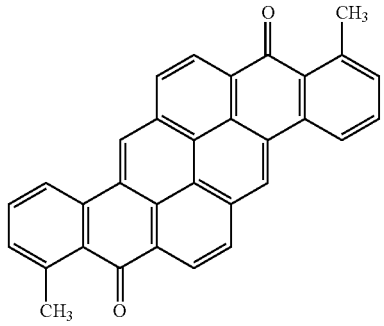

-continued
CGM-3
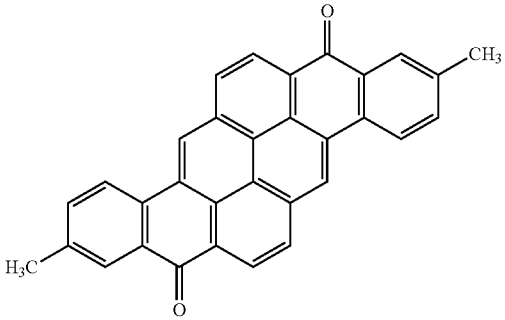
CGM-4
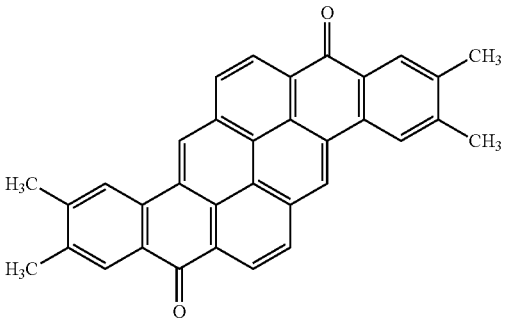
CGM-5
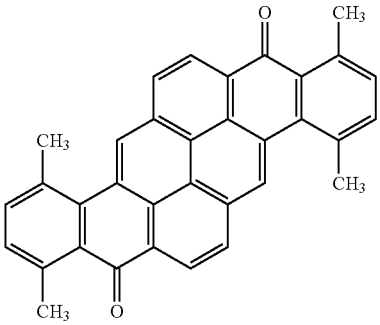
CGM-6
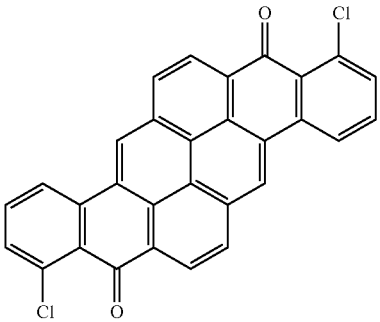
-continued
CGM-7
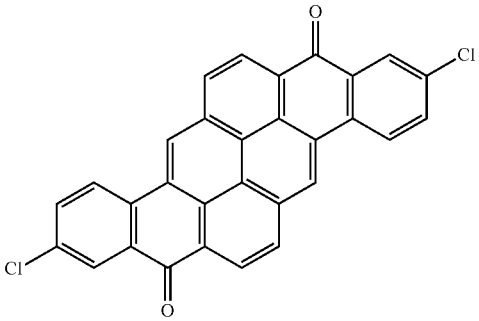
CGM-8
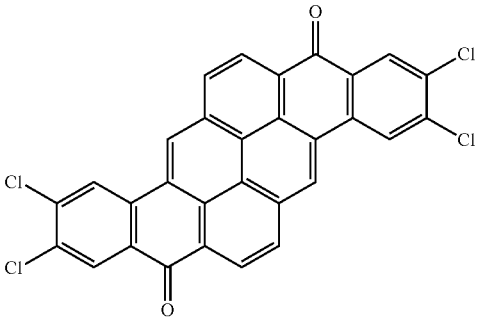
CGM-9
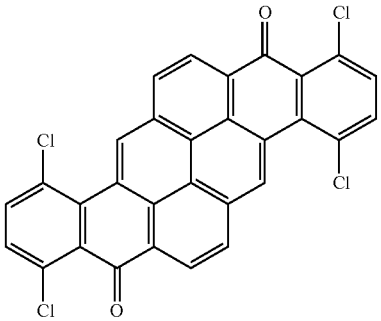
CGM-10
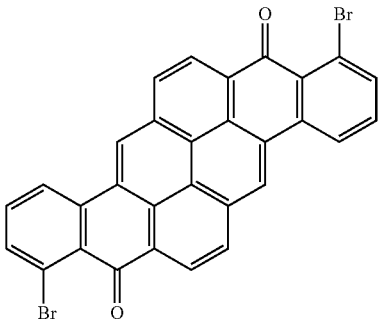

-continued
CGM-11
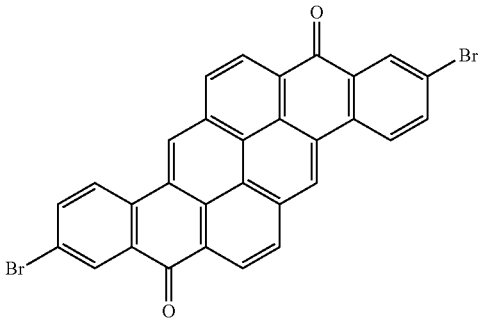
CGM-12
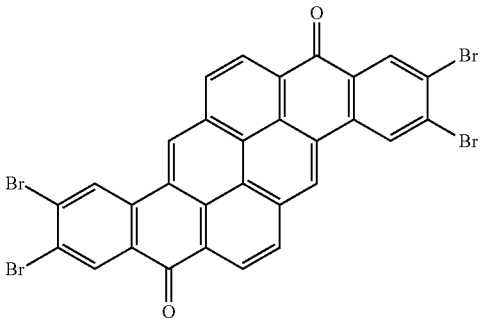
CGM-13
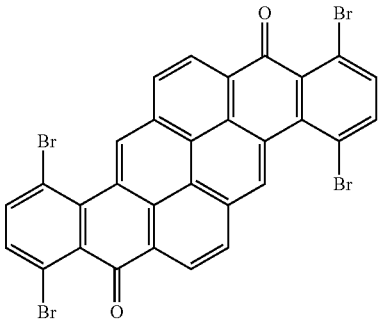
CGM-14
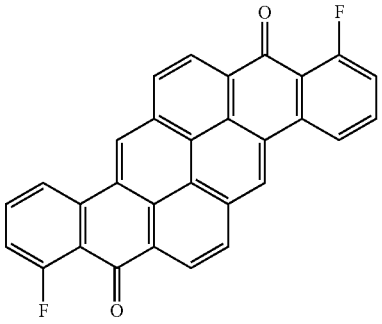
-continued
CGM-15
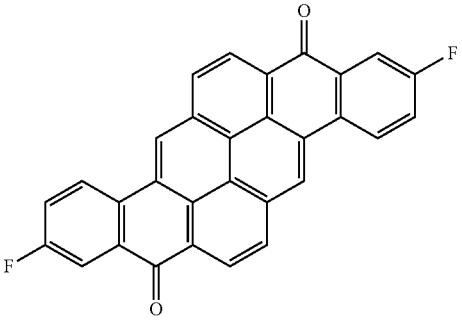
CGM-16
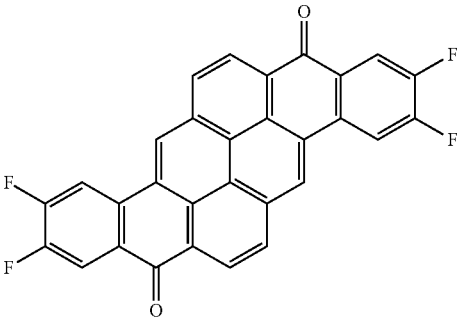
CGM-17
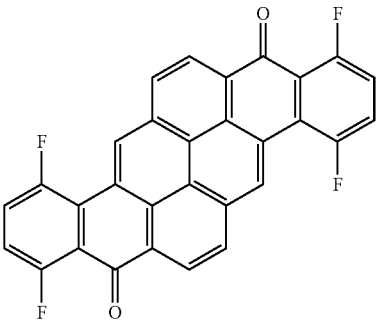
CGM-18
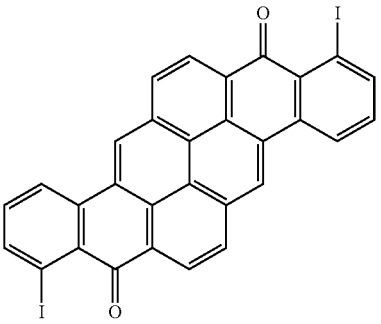

-continued
CGM-19
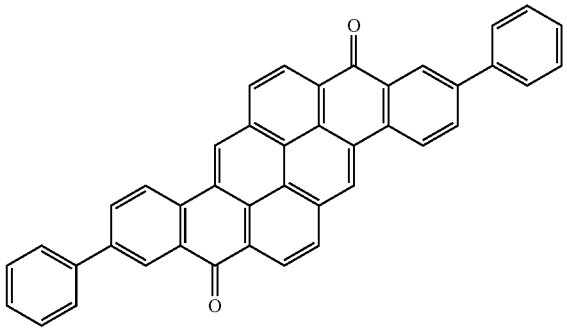
CGM-20
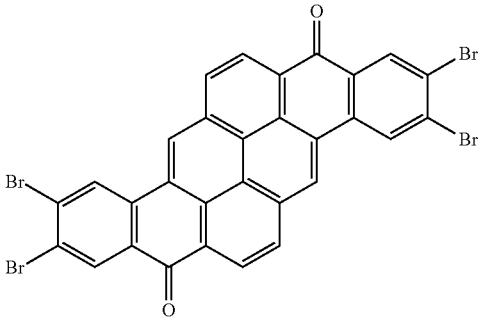
CGM-21
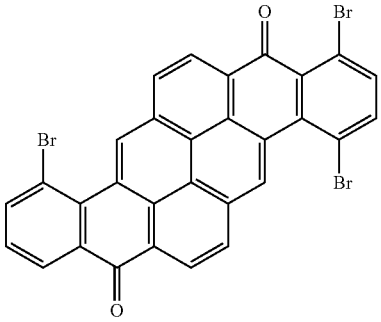
CGM-22
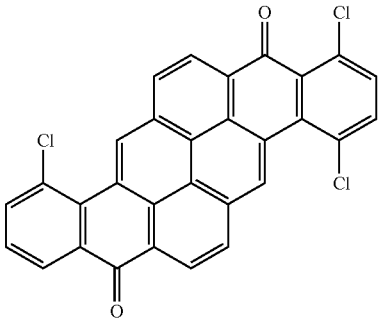
-continued
CGM-23
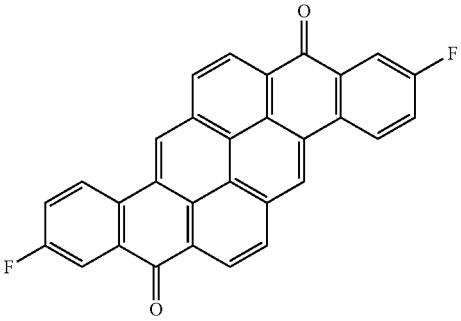
CGM-24
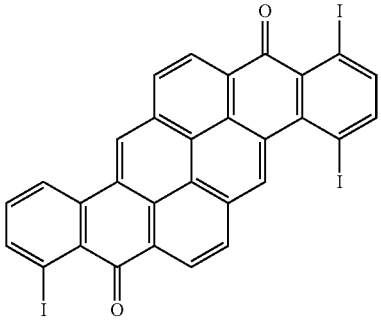
CGM-25
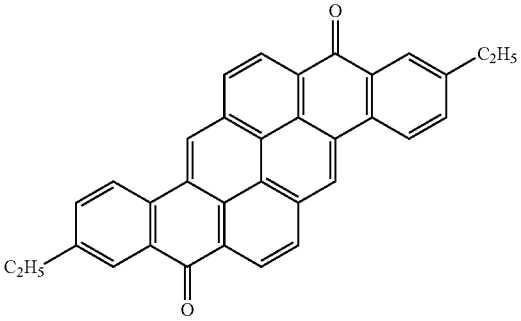
CGM-26
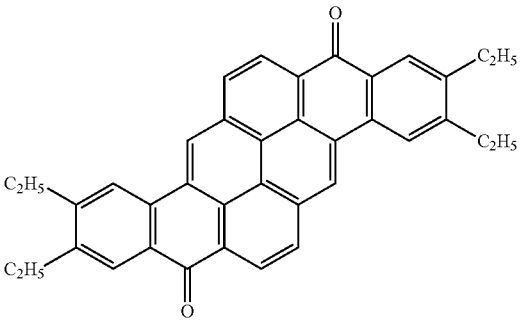

-continued

CGM-27

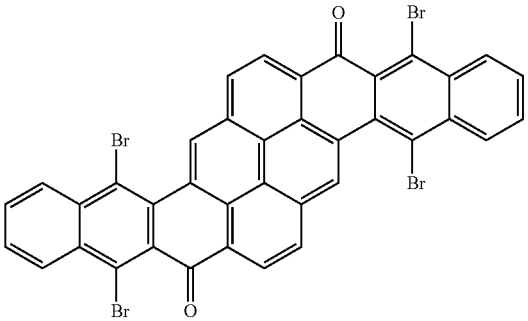

CGM-28

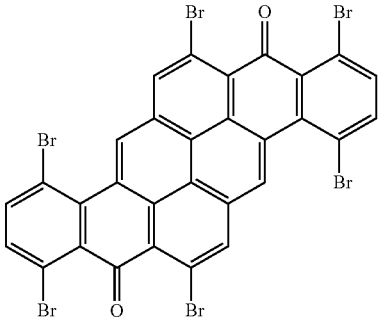

CGM-29

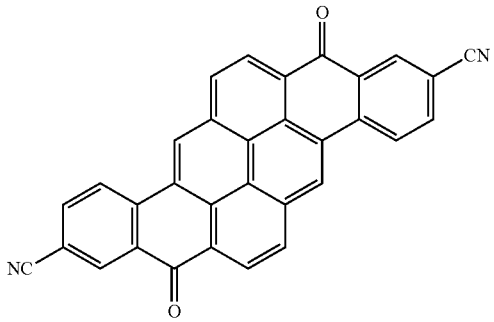

CGM-30

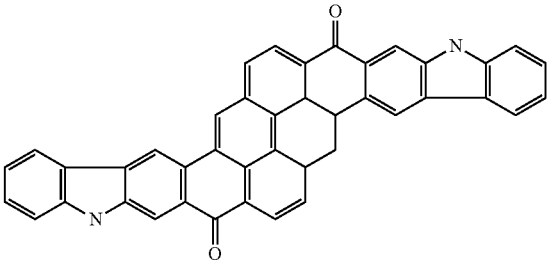

In the present invention, these pyranthrone pigments can be used in combination.

[Structure of Electrophotographic Photoreceptor in the Present Invention]

The structure of electrophotographic photoreceptor in the present invention will be described below.

The structure of electrophotographic photoreceptor in the present invention is not specifically limited as long as a pyranthrone pigment, and a charge transport material represented by Formula (1) or Formula (2) described above are contained. For example, the following structures are provided.

(1) A structure in which a charge generation layer and a charge transport layer are layered in order on a conductive support as the photosensitive layer (2) A structure in which the charge generation layer, the first charge transport layer, and the second charge transport layer are layered in order on a conductive support as the photosensitive layer (3) A structure in which a surface protective layer is further formed on the photosensitive layer of a photoreceptor in (1) or (2) described above.

Any of the above-described structures may be applied to the organic photoreceptor of the present invention.

In addition, even though the photoreceptor of the present invention has any of the above-described structures, a subbing layer (intermediate layer) is preferably formed before forming the photosensitive layer on the conductive support.

In addition, the surface layer of the photoreceptor in the present invention means a layer where the photoreceptor is in contact with the air interface.

Next, the layer structure of a photoreceptor referring to the above-described (2) will be mainly described.

(Conductive Support)

Any of a conductive support in the form of a sheet and a cylindrical conductive support used for a photoreceptor may be employed, but in order to compactly design an image forming apparatus, the cylindrical conductive support is preferable.

The cylindrical conductive support means a cylindrical support to endlessly form images via rotation, and the conductive support having a straightness of 0.1 mm or less and a swing width of 0.1 mm or less is preferable. When the straightness and the swing width exceed the above-described ranges, excellent images are difficult to be formed.

Usable are a metal drum made of aluminum, nickel or the like as a conductive material, a plastic drum on which aluminum, tin oxide, indium oxide or the like is evaporated, a paper or plastic drum on which a conductive material is coated. A conductive support having a specific resistance of not more than $10^3$ Ω·cm at room temperature is preferable. An aluminum support is most preferable as a conductive support of the present invention. One mixed with components such as manganese, zinc, magnesium and so forth other than aluminum as a main component are also employed for the aluminum substrate.

(Intermediate Layer)

In the present invention, an intermediate layer is preferably provided between a conductive support and a photosensitive layer.

The intermediate layer preferably contains N-type semiconductor particles. The N-type semiconductor particles mean particles in which the charge carrier is mainly an electron. That is, since the charge carrier is mainly is an electron, the intermediate layer in which the N-type semiconductor particles are contained in an insulation binder blocks hole injection from the substrate efficiently, and exhibits less blocking against electrons from the photosensitive layer.

Titanium oxide ($TiO_2$) and zinc oxide (ZnO) are preferable as the N-type semiconductor particles, and titanium oxide to be used is particularly preferable.

Particles having a number average primary particle diameter of 3-200 nm are used as the N-type semiconductor particles. Those having a number average primary particle diameter of 5-100 nm are specifically preferable in view of even dispersibility of particles in an intermediate layer binder and prevention of degradation of dot images.

The number average primary particle diameter is a measured value obtained by observing randomly selected 100 particles as the primary particles employing a transmission electron microscope under a magnification of 10,000 times and computing their average diameter in the Feret direction via image analysis.

Further, an intermediate layer coating solution prepared to form an intermediate layer is composed of a binder resin and a dispersing solvent other than N-type semiconductor particles such as those made of titanium oxide subjected to the foregoing surface treatment.

The ratio of the N-type semiconductor particles in the intermediate layer is preferably 1.0-2.0 times on terms of a volume ratio with respect to a binder resin in the intermediate layer (provided that volume of the binder resin is set to 1). When the N-type semiconductor particles are used at such the high density in the intermediate layer, rectification of the intermediate layer is raised, and increase of residual potential and degradation of dot images can be effectively inhibited even though a thicker layer is prepared, whereby an excellent organic photoreceptor can be formed.

On the other hand, as a binder resin to disperse these particles and to form a layer structure of the intermediate layer, a polyamide resin is preferable in order to obtain excellent dispersibility of particles, but the following polyamide resins are specifically preferred.

An alcohol-soluble polyamide resin is preferable as a binder resin for the intermediate layer, and a resin exhibiting high solubility in a solvent is desired in order to form an intermediate layer having uniform thickness. As such the alcohol-soluble polyamide resin, a copolymerized polyamide resin and a methoxy methylated polyamide resin which are composed of a chemical structure having few carbon chains between amide bonds such as 6-Nylon and so forth are known.

The following polyamide resins are also preferably used.

N-1

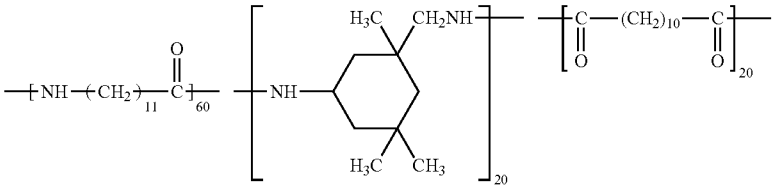

(100%)

N-2

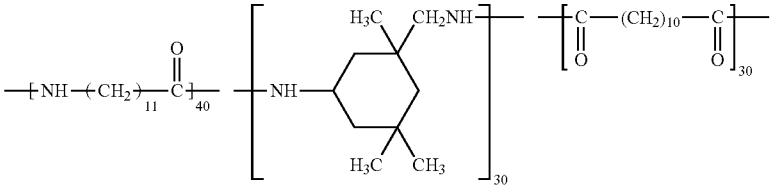

(100%)

N-3

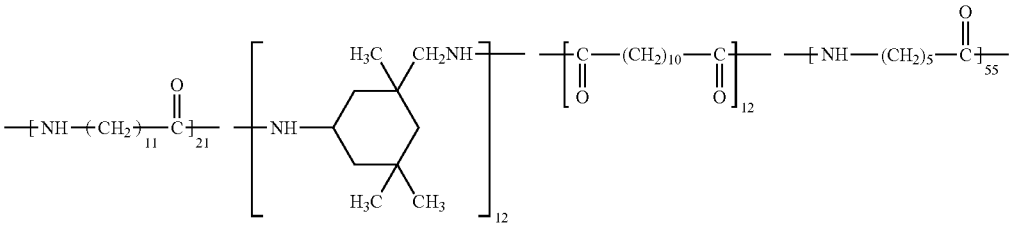

(45%)

N-4

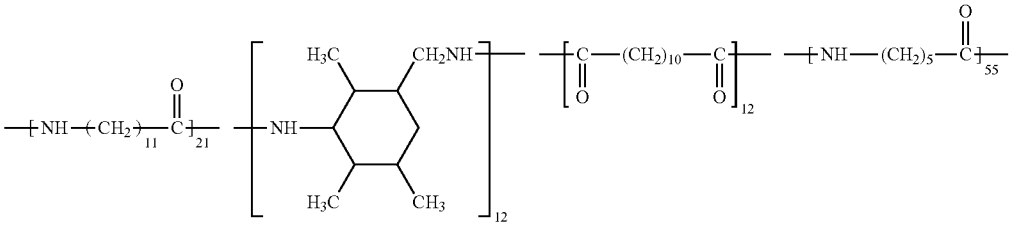

(45%)

N-5

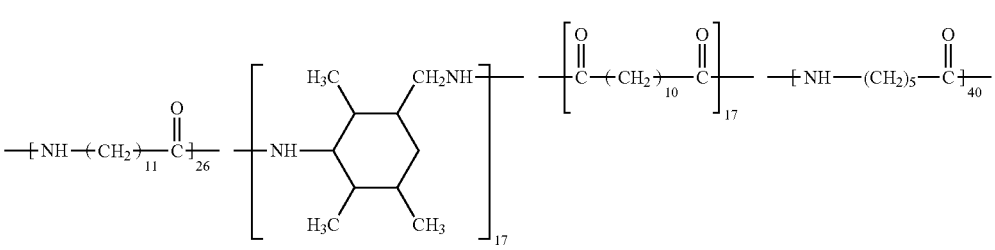

(60%)

Further, the above-described polyamide resin preferably has a number average molecular weight of 5,000-80,000 as a molecular weight, and more preferably has a number average molecular weight of 10,000-60,000.

The polyamide resin has already been commercially available in part, and is sold under the trade name of VESTAMELT X1010, X4685 and so forth, for example, produced by Daicel•Degussa Ltd.

Preferable examples of the solvent to prepare a coating solution after dissolving the above-described polyamide resin include alcohols each having 2-4 carbon atoms such as ethanol, n-propyl alcohol, isopropyl alcohol, n-butanol, t-butanol, sec-butanol and so forth, and these are excellent in view of solubility of polyamide and coatability of the resulting coating solution. The solvent in the total solvent has a content of 30-100% by weight, preferably has a content of 40-100% by weight, and more preferably has a content of 50-100% by weight. Examples of the auxiliary solvent with which a preferable effect is produced by using the foregoing solvent in combination include methanol, benzyl alcohol, toluene, methylene chloride, cyclohexanone, tetrahydrofuran and so forth.

The intermediate layer preferably has a thickness of 0.3-10 μm, and more preferably has a thickness of 0.5-5 μm in view of prevention of generation of black spots and prevention of dot image deterioration caused by rise in residual potential.

Further, the intermediate layer is desired to be substantially an insulating layer. Herein, the insulating layer means a layer having a volume resistance of at least $1\times10^{8}$ Ω·cm. Each of the intermediate layer and the protective layer in the present invention preferably has a volume resistance of $1\times10^{8}$-$1\times10^{15}$ Ω·cm, and more preferably has a volume resistance of $2\times10^{9}$-$1\times10^{13}$ Ω·cm in view of prevention of generation of black spots caused by drop in charge blocking property and prevention of drop in image quality caused by residual potential increased via repetitive image formation.

(Charge Generation Layer)

A charge generation material exhibiting a high sensitivity characteristic in the wavelength region of 350-500 nm is preferably employed as charge generation material (CGM) for an organic photoreceptor of the present invention. A pyranthrone pigment is provided as such a charge generation material. A pyranthrone pigment represented by foregoing Formula (3) is specifically preferable in the present invention.

The charge generation layer is preferably used as a dispersing medium for CGM. Commonly known resins are usable as binders, but Examples of the most preferable resins include a formal resin, a butyral resin, a silicone resin, a silicone-modified butyral resin and a phenoxy resin.

The ratio of a charge generation material to a binder is preferably 20-600 parts of charge generation material with respect to 100 parts by weight of binder. Use of such a resin can minimize residual potential increased via repetitive use. The charge generation layer preferably has a thickness of 0.3-2 μm.

(Charge Transport Layer)

In the present invention, the charge transport layer may be composed of a single charge transport layer or a plurality of charge transport layers. When the charge transport layer may be composed of a plurality of charge transport layers, a charge transport layer as the uppermost layer preferably contains inorganic particles.

The charge transport layer contains charge transport material (CTM) and a binder resin for dispersing CTM to conduct film formation. Additives such as an antioxidant and so forth may be contained as the other material, if desired.

The charge transport layer contains at least one of compounds represented by foregoing Formula (1) or Formula (2) as charge transport material (CTM), but hole transporting (p type) charge transport material other than the foregoing may be used in combination. Usable examples thereof include a triphenylamine derivative, a hydrazone compound, a styryl compound, a benzidine compound and so forth as those other than compounds relating to the present invention as described above. Layer formation is conducted by usually dissolving the charge transport material in an appropriate binder resin. However, the charge transport material used in combination is desired to have less than one-half of the total parts by weight of compounds represented by foregoing Formula (1) or Formula (2) in the present invention.

A binder resin used for charge transport layer (CTL) may be any of a thermoplastic resin and a thermosetting resin. Examples thereof include polystyrene, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, and a copolymeric resin containing at least two of the repeating units of the above-described resins. A polymeric organic semiconductor such as poly-N-vinylcarbazole or the like other than these insulating resins is also provided. Among them, most preferable is a polycarbonate resin exhibiting low water absorption together with excellent dispersibility of CTM and excellent electrophotographic properties.

It is preferable that the ratio of a charge transport material to a binder resin is of 50-200 parts by weight with respect to 100 parts by weight of the binder resin.

The charge transport layer preferably has a total layer thickness of 10-25 μm. Further, the charge transport layer as a surface layer preferably has a layer thickness of 1.0-8.0 μm.

Examples of the solvent or dispersion medium employed for forming an intermediate layer, a charge generation layer, a charge transport layer and so forth include n-Butylamine, diethylamine, ethylenediamine, iso-propanolamine, triethanolamine, triethylenediamine, N,N-dimethylformamide, acetone, methyl ethyl ketone, methyl isopropyl ketone, cyclohexane, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide and methyl cellosolve. The present invention is not limited thereto, but an environmental friendly solvent such as tetrahydrofuran, methylethyl ketone or the like is preferably employed. These solvents may also be used singly or as a mixed solvent in combination with at least two kinds.

Next, coat-processing methods such as an immersion coating method, a spray coating method and so forth in addition to a coating method with a slide hopper type coating apparatus are employed as the coat-processing method to prepare an organic photoreceptor. In order to form a surface layer of the present invention, most preferable is a coating method with a circular slide hopper type coating apparatus.

Among the above-described coating solution supplying type coating apparatuses, the coat-processing method with a slide hopper type coating apparatus is most preferable when a dispersion in which the foregoing low boiling point solvent is used is employed as a coating solution, and coating is preferably carried out employing a circular slide hopper type coating apparatus described in Japanese Patent O.P.I. Publication No. 58-189061 in detail in the case of a cylinder-shaped photoreceptor.

In the case of a coating method with a circular slide hopper type coating apparatus, coating can be carried out with no damage of a substrate since the slide surface end and the substrate are placed at an interval of about 2 μm-2 mm, and also with no damage of coated layers even though a plurality of layers each exhibiting a different property are layered. Further, coating can be carried out with almost no elution of the lower layer component to the upper layer side since the duration being in a solvent is very short in comparison to an immersion coating method even though a plurality of layers each exhibiting a different property and dissolving in an identical solvent are layered, and also with no degradation of dispersibility of metal oxide particles in the present invention since coating can be carried out with no elution to a coat tank.

An antioxidant is preferably contained in a surface layer of the photoreceptor in the present invention from the viewpoint of prevention of image blurring. The surface layer is easy to be oxidized by reactive gas such as $NO_x$, ozone and so forth during electrification of the photoreceptor, and image blurring tends to be generated, but generation of image blurring can be inhibited via coexistence of the antioxidant.

The antioxidant is a substance as a typical one exhibiting a property by which action of oxygen is controlled or inhibited under the condition of light, heat, discharge or the like, with respect to an auto-oxidizing substance existing in the photoreceptor or on the surface of the photoreceptor. The following groups of compounds are typically exemplified.

AO1-1

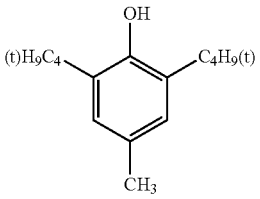

AO1-2

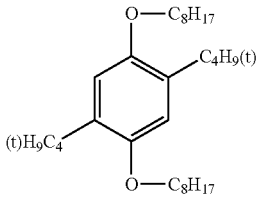

AO1-3

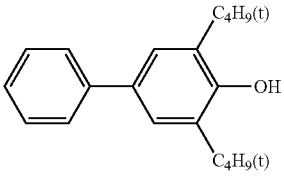

AO1-4

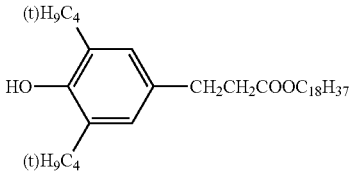

AO1-5

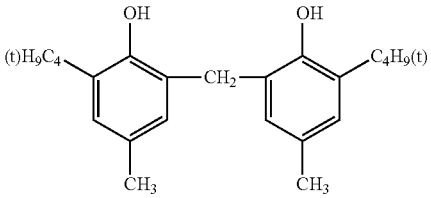

AO1-6

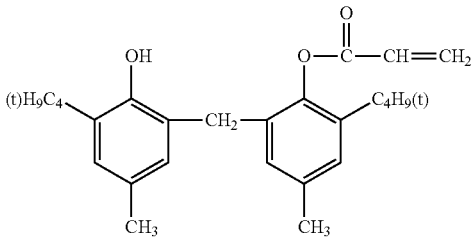

AO1-7

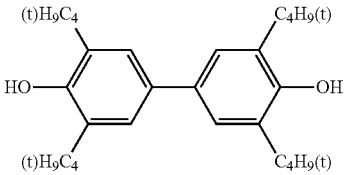

AO1-8

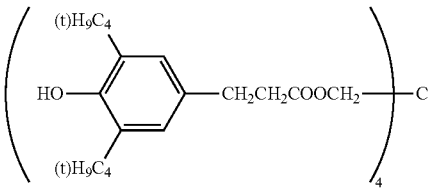

AO1-9

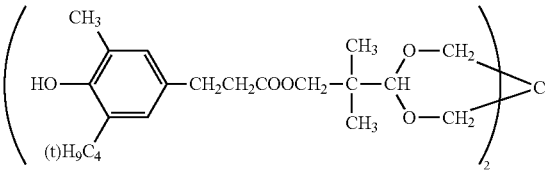

AO1-10

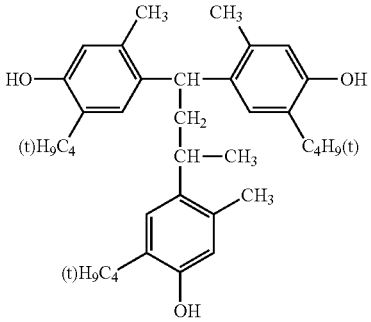

-continued

AO2-1

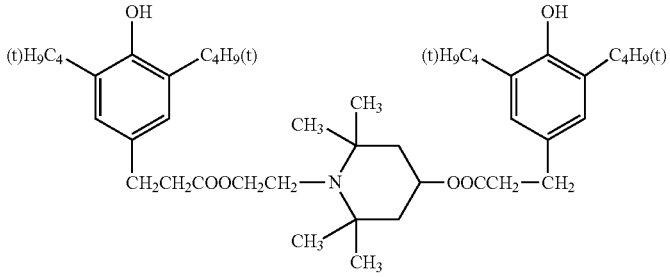

AO2-2

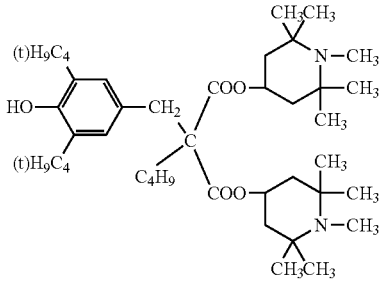

AO2-3

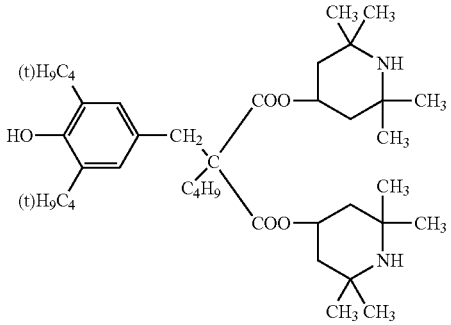

AO2-4

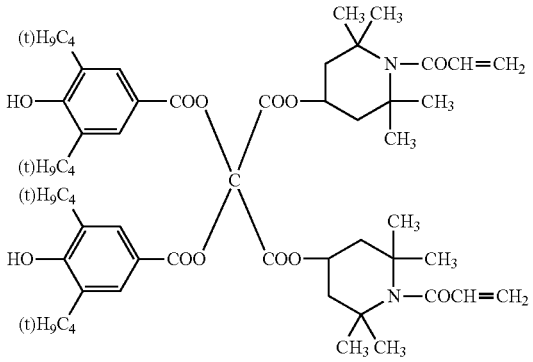

AO2-5

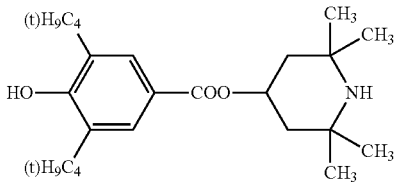

AO2-6

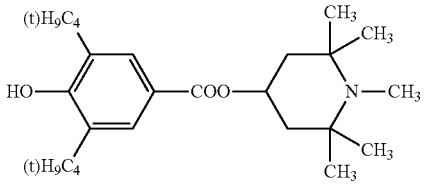

AO2-7

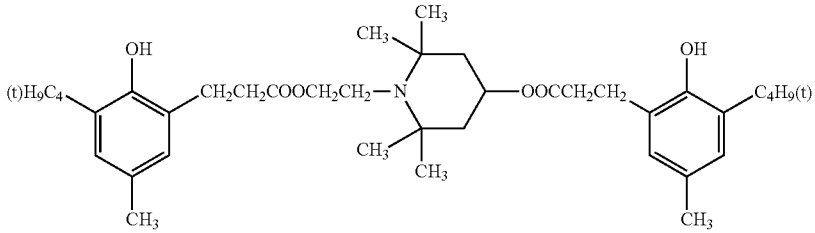

[Image Forming Apparatus]

Next, an image forming apparatus in which an organic photoreceptor of the present invention is installed will be described.

FIG. 1 is a cross-sectional diagram of a color image forming apparatus in an embodiment of the present invention.

This color image forming apparatus is called the so-called tandem type color image forming apparatus, and comprises four sets of image forming sections (image forming units) 10Y, 10M, 10C, and 10Bk, endless belt shaped intermediate transfer member unit 7, sheet feeding and conveyance device 21, and fixing device 24. The original document reading apparatus SC is placed on top of main unit A of the image forming apparatus.

Image forming section 10Y that forms images of yellow color comprises charging device 2Y, light exposure device 3Y, developing device 4Y, primary transfer roller 5Y as a primary transfer section, and cleaning device 6Y all placed around drum-formed photoreceptor 1Y which acts as the first image supporting body. Image forming section 10M that forms images of magenta color comprises drum-formed photoreceptor 1M which acts as the first image supporting body, charging device 2M, light exposure device 3M, developing device 4M, primary transfer roller 5M as a primary transfer section, and cleaning device 6M. Image forming section 10C that forms images of cyan color comprises drum-formed photoreceptor 1C which acts as the first image supporting body, charging device 2C, light exposure device 3C, developing device 4C, primary transfer roller 5C as a primary transfer section, and cleaning device 6C. Image forming section 10Bk that forms images of black color comprises drum-formed photoreceptor 1Bk which acts as the first image supporting body, charging device 2Bk, light exposure device 3Bk, developing device 4Bk, primary transfer roller 5Bk as a primary transfer section, and cleaning device 6Bk.

That is, four sets of image forming units 10Y, 10M, 10C, and 10Bk are constituted, centering on photoreceptor drums 1Y, 1M, 1C, and 1Bk, by rotating charging devices 2Y, 2M, 2C, and 2Bk, image wise light exposure devices 3Y, 3M, 3C, and 3Bk, rotating developing devices 4Y, 4M, 40C and 4Bk, and cleaning devices 6Y, 6M, 6C, and 6Bk that clean photoreceptor drums 1Y, 1M, 1C, and 1Bk.

Image forming units 10Y, 10M, 10C, and 10Bk, all have the same configuration excepting that the color of the toner image formed in each unit is different on respective photoreceptor drums 1Y, 1M, 1C, and 1Bk, and detailed description is given below taking the example of image forming unit 10Y.

Image forming unit 10Y forms yellow (Y) colored toner image on photoreceptor drum 1Y by placing charging device 2Y (hereinafter referred to simply as charging unit 2Y or charger 2Y), light exposure device 3Y, developing device 4Y, and cleaning device 6Y (hereinafter referred to simply as cleaning device 6Y or as cleaning blade 6Y) around photoreceptor drum 1Y as an image forming body. Further, in the present preferred embodiment, at least photoreceptor drum 1Y, charging device 2Y, developing device 4Y, and cleaning device 6Y in image forming unit 10Y are provided in an integral manner.

Charging device 2Y is a device that applies a uniform electrostatic potential to photoreceptor drum 1Y, and corona discharge type charger 2Y is being used for photoreceptor drum 1Y in the present preferred embodiment.

Imagewise light exposure device 3Y is a device that conducts light exposure, based on an image signal (Yellow), and forms an electrostatic latent image corresponding to the yellow color image. This light exposure device 3Y is one composed of LED arranged in the form of an array in the direction of photoreceptor drum 1Y axis, and an image focusing element (product name: Selfoc lens), or is a laser optical system.

The image forming apparatus of the present invention may be configured in such a way that the constituents such as the foregoing photoreceptor, a developing device, a cleaning device and so forth are integrally combined to a process cartridge (image forming unit), and this image forming unit may be installed in the apparatus main body as a detachable unit. It is also possible to arrange such a configuration that at least one of the charging device, the imagewise light exposure device, the developing device, the transfer or separation device and the cleaning device is integrally supported with the photoreceptor to form a process cartridge (image forming unit) as a single detachable image forming unit, employing a guide device such as a rail of the apparatus main body.

Intermediate transfer member unit 7 in the form of an endless belt is wound around a plurality of rollers, and has endless belt shaped intermediate transfer member 70 which acts as a second image carrier in the shape of a partially conducting endless belt which is supported in a free manner to rotate.

The images of different colors formed by image forming units 10Y, 10M, 10C, and 10Bk, are successively transferred on to rotating endless belt shaped intermediate transfer member 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final fixed image: for example, plain paper, transparent sheet, etc., is fed from sheet feeding device 21, pass through a plurality of intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24, and is gripped by sheet discharge rollers 25 and placed above sheet discharge tray 26 outside the equipment.

On the other hand, after the color image is transferred to transfer material P by secondary transfer roller 5*b* functioning as the secondary transfer section, endless belt shaped intermediate transfer member 70 from which transfer material P has been separated due to different radii of curvature is cleaned by cleaning device 6*b* to remove the remaining toner.

Secondary transfer roller 5*b* comes into contact with endless belt shaped intermediate transfer body 70 only when secondary transfer is conducted with transfer material P passing through this.

Further, chassis 8 can be pulled out via supporting rails 82L and 82R from body A of the apparatus.

In addition, chassis 8 possesses image forming sections 10Y, 10M, 10C, and 10Bk, and endless belt shaped intermediate transfer member unit 7 as main constituent elements.

Image forming sections 10Y, 10M, 10C, and 10Bk are arranged in column in the vertical direction. Endless belt shaped intermediate transfer member unit 7 is placed to the left side in the figure of photoreceptor drums 1Y, 1M, 1C, and 1Bk. Endless belt shaped intermediate transfer member unit 70 possesses endless belt shaped intermediate transfer member 70 that can rotate around rollers 71, 72, 73, and 74, primary image transfer rollers 5Y, 5M, 5C, and 5Bk, and cleaning device 6*b*.

Figure 2:
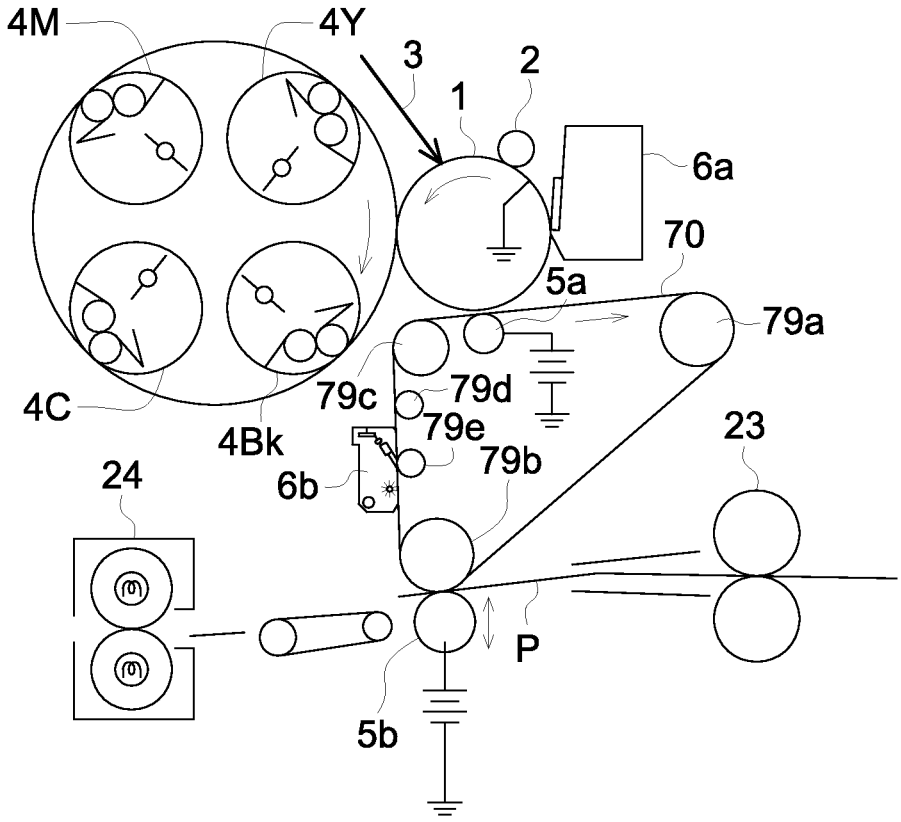
FIG. 2 is a schematic diagram of an image forming apparatus relating to the present invention.

Next, FIG. 2 is a cross-sectional view of a color image forming apparatus possessing an organic photoreceptor of the present invention (a copier or a laser beam printer possessing at least a charging device, a light exposure device, a plurality of developing devices, an image transfer device, a cleaning device, and an intermediate transfer member provided around the organic photoreceptor). An elastic body with a medium level of electrical resistivity is employed for belt shaped intermediate transfer member 70.

Numeral 1 represents a rotating drum type photoreceptor that is repetitively used as the image carrying body, and is driven to rotate with a specific circumferential velocity in the anticlockwise direction indicated by the arrow.

During rotation, photoreceptor 1 is evenly charged to a specific polarity and potential by charging device (charging process) 2, and next, when it receives image exposure obtained via scanning exposure light with a laser beam modulated in accordance with the time-serial electrical digital pixel signal of the image information from imagewise light exposure device (imagewise light exposure process) 3 not shown in the figure, formed is an electrostatic latent image corresponding to yellow (Y) color component image (color information) as an intended color image.

Next, the electrostatic latent image is developed by yellow (Y) developing device (yellow color developing device) 4Y employing the yellow toner as the first color. In this case, the second developing device to the fourth developing device (magenta color developing device, cyan color developing device, and black color developing device) 4M, 4C, and 4Bk each are in the operation switched-off state and do not act on photoreceptor 1, and the yellow toner image of the above-described first color does not get affected by the above-described second developing device to fourth developing device.

Intermediate transfer member 70 is passed through rollers 79*a*, 79*b*, 79*c*, 79*d*, and 79*e* and is driven to rotate in the clockwise direction with the same circumferential speed as that of photoreceptor 1.

The yellow toner image of the first color formed and retained on photoreceptor 1 is, in the process of passing through the nip section between photoreceptor 1 and intermediate transfer member 70, intermediate-transferred (primary transferred) successively to the outer peripheral surface of intermediate transfer member 70 due to the electric field formed by the primary transfer bias voltage applied from primary transfer roller 5*a* to intermediate transfer member 70.

The surface of photoreceptor 1 after it has completed the transfer of the first color yellow toner image to intermediate transfer member 70 is cleaned by cleaning device 6*a*.

In the same manner as described above, the second color magenta toner image, the third color cyan toner image, and the fourth color black toner image are transferred successively on to intermediate transfer member 70 in a superimposing manner, thereby forming the superimposed color toner image corresponding to the intended color image.

Secondary transfer roller 5*b* is placed so that it is supported by bearings parallel to secondary transfer opposing roller 79*b* and pushes against intermediate transfer member 70 from below in a separable condition.

In order to carry out successive overlapping transfer of the toner images of the first to fourth colors from photoreceptor 1 to intermediate transfer member 70, the primary transfer bias voltage applied has a polarity opposite to that of the toner and is applied from the bias power supply. This applied voltage is, for example, in the range of +100 V to +2 kV.

During the primary transfer process of transferring the first to the fourth color toner image from photoreceptor 1 to intermediate transfer member 70, secondary transfer roller 5*b* and intermediate transfer member cleaning device 6*b* can be separated from intermediate transfer member 70.

The transfer of the superimposed color toner image transferred onto belt shaped intermediate transfer member 70 on to transfer material P which is the second image supporting body is done when secondary transfer roller 5*b* is in contact with the belt of intermediate transfer member 70, and transfer material P is fed from corresponding sheet feeding resist roller 23 via the transfer sheet guide to the contacting nip between secondary transfer roller 5*b* and intermediate transfer member 70 at a specific timing. The secondary transfer bias voltage is applied from the bias power supply to secondary image transfer roller 5*b*. Because of this secondary transfer bias voltage, the superimposed color toner image is transferred (secondary transfer) from intermediate transfer member 70 to transfer material P which is the second image supporting body. Transfer material P which has received the transfer of the toner image is guided to fixing device 24 and is heated and fixed there.

The image forming apparatus of the present invention is commonly suitable for electrophotographic apparatuses such as electrophotographic copiers, laser printers, LED printers, liquid crystal shutter type printers and so forth. Further, the image forming apparatus can be widely utilized for apparatuses for displaying, recording, light printing, plate making and facsimile to which an electrophotographic technique is applied.

EXAMPLE

Next, the present invention will be described in detail referring to Examples, but embodiments of the present invention are not limited thereto. In addition, "parts" described below represent "parts by weight".

Example 1

Preparation of Photoreceptor 1

Photoreceptor 1 was prepared as described below.

Intermediate Layer

The following intermediate layer coating solution was coated on a washed circular aluminum substrate by an immersion coating method, and dried at 120° C. for 30 minutes to form an intermediate layer having a dry thickness of 5 μm.

(Preparation of Intermediate Layer Coating Solution)

The following intermediate layer dispersion was diluted two times with the same mixed solvent, and it was left standing overnight. Then it was filtered by a filter (RIGIMESH produced by Nihon Pall Corp., with a filtration accuracy of 5 μm and a pressure of 50 kPa) to prepare the intermediate layer coating solution.

| (Preparation of intermediate layer dispersion) | |
|---|---|
| Binder resin (exemplified polyamide N-1) | 1.0 part |
| Rutile type titanium oxide (a titanium oxide pigment having a primary particle diameter of 35 nm and surface-treated with dimethyl polysiloxane having a hydroxy group at the terminal to have a hydrophobicity degree of 33) | 5.6 parts |
| Ethanol/n-propyl alcohol/THF (= 45/20/30 in weight ratio) | 10 parts |

The above-described components were mixed for 10 hours emptying a batch type sand mill dispersing machine to prepare an intermediate layer dispersion.

| Charge generation layer (CGL) | |
|---|---|
| Charge generation material (CGM): Exemplified compound CGM-1 | 24 parts |
| Polyvinyl butyral resin (S-Lec BL-1, produced by Sekisui Chemical Co., Ltd.) | 12 parts |
| 2-butanone/cyclohexanone = 4/1 (in volume ratio) | 300 parts |

The above-described components were mixed and dispersed employing a sand mill to prepare a charge generation layer coating solution. This coating solution was coated with an immersion coating method to form a charge generation layer having a dry thickness of 0.5 μm on the foregoing intermediate layer.

| Charge transport layer (CTL) | |
|---|---|
| Charge transport material (Exemplified compound CTM-1) | 225 parts |
| Polycarbonate (Z300, produced by Mitsubishi Gas Chemical Company, Ltd.) | 300 parts |
| Antioxidant (Exemplified compound AO1-3) | 3 parts |
| Dichloromethane | 2000 parts |
| Silicone oil (KF-96, produced by Shin-Etsu Chemical Co., Ltd.) | 1.0 part |

The above-described components were mixed, and dissolved to prepare charge transport layer coating solution 1. This coating solution was coated on the foregoing charge generation layer by an immersion coating method, followed by drying at 120° C. for 7-minutes to form a charge transport layer having a dry thickness of 20.0 μm. Thus, photoreceptor 1 was prepared.

Preparation of Each of Photoreceptors 2-10

Each of photoreceptors 2-10 was prepared similarly to preparation of photoreceptor 1, except that the charge generation material and the charge transport material were changed to those described in Table 1.

In Table 1, CTM-R1 and CTM-R2 are compounds exemplified below.

CTM-R1

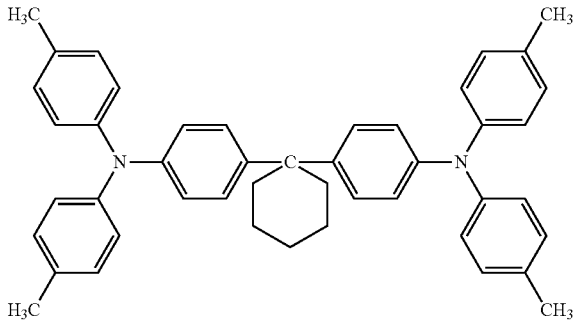

CTM-R2

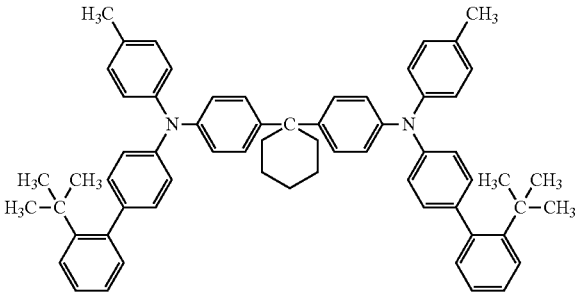

TABLE 1

| Photo-receptor No. | Charge generation material No. | Charge transport material No. |
|---|---|---|
| 1 | CGM-13 | CTM-1 |
| 2 | CGM-10 | CTM-1 |
| 3 | CGM-13 | CTM-3 |
| 4 | CGM-10 | CTM-3 |
| 5 | CGM-13 | CTM-5 |
| 6 | CGM-10 | CTM-5 |
| 7 | CGM-13 | CTM-6 |
| 8 | CGM-10 | CTM-6 |
| 9 | CGM-13 | CTM-R1 |
| 10 | CGM-10 | CTM-R2 |

[Evaluation of Photoreceptor]

As to the resulting photoreceptor, evaluations of sensitivity, a repetitive property and potential stability, and image evaluations (1 dot line and 2 dot line) were made as described below.

(Sensitivity)

A digital copier bizhub920 (manufactured by Konica Minolta Business Technologies, Inc.) was remodeled for the process conditions in such a way that light exposure is conducted at 1200 dpi {the number of dots/inch (2.54 cm)} with a beam diameter of 30 μm employing a semiconductor laser having a wavelength of 405 nm as an imagewise exposure light source, and further remodeled so as to be able to measure potential on the surface of a photoreceptor with a surface potentiometer.

The photoreceptor is charged so as to be at a surface potential of −700 V, and an amount of light necessary to attenuate from the surface potential to at a surface potential of −350 V is measured via light exposure to obtain sensitivity (E1/2).

The smaller the sensitivity (E1/2), the better the property is.

Sensitivity was similarly measured by changing the semiconductor laser to semiconductor laser having a wavelength of 450 nm as well as 500 nm as an exposure light source. As a result, the sensitivity denoted the same tendency as in the case of the semiconductor laser having a wavelength of 450 nm as well as 500 nm as an exposure light source.

(Repetitive Property)

Initial dark area electrical potential (Vd) and initial bright area electrical potential (Vi) were set to about −700 V and −200 V, respectively, employing the remodeled copier (employing a semiconductot laser having a wavelength of 405 nm) used for measuring sensitivity, and charging and light exposure were repeated 3,000 times to measure variation amounts of Vd and Vi (ΔVd and ΔVi) for the measurement ofrepetitive property of charging and light exposure, which was designated as one of indicators of durability. In addition, the minus represents reduction in electrical potential, and the plus represents rise in electrical potential. Smaller one in elechical potential difference absolute value exhibits an excellent property.

(Potential Stability)

Effects produced via exposure to external light were determined. Electrical potential (Vi) of an exposed area (bright area) before or after the photoreceptor was exposed to a fluorescent lamp at 1000 lux for 30 minutes was measured employing the above-described remodeled copier to evaluate potential stability, which was designated as one of indicators of durability. Smaller value in potential difference before or after exposure to a fluorescent lamp exhibits an excellent property.

(Dot Image Evaluation)

Each of photoreceptors 1-10 was placed in the remodeled copier (employing a semiconductot laser having a wavelength of 405 nm) used for measuring sensitivity to evaluate dot images, which is designated as an indicator of image reproduction. As to the photoreceptor after exposure to a fluorescent lamp, dot images were evaluated to evaluate image reproduction caused by deterioration. Evaluation items and evaluation criteria are shown below. In addition, dpi represents the number of dots per 2.54 cm.

<One Dot Line>

A one dot line and a solid black image were formed on a white A4 size paper sheet, and evaluations were made in accordance with the following criteria.

A: The one dot line is continuously reproduced, and the solid black image density is 1.2 or more (Excellent).

B: The one dot line is continuously reproduced, but the solid black image density is at least 1.0 and less than 1.2. (Practically with no problem).

C: The one dot line is not continuously reproduced, or even though the one dot line is continuously reproduced, the solid black image density is less than 1.0 (Practically with a problem).

<Two Dots Line>

A white two dots line was formed in a solid black image, and evaluations were made in accordance with the following criteria.

A: A white line of the two dots line is continuously reproduced, and the solid black image density is 1.2 or more (Excellent).

B: A white line of the two dots line is continuously reproduced, but the solid black image density is at least 1.0 and less than 12. (Practically with no problem).

C: A white line of the two dots line is not continuously reproduced, or even though the white line of the two dots line is continuously reproduced, the solid black image density is less than 1.0 (Practically with a problem).

The above-described image density was measured employing a densitometer RD-918 manufactured by Macbeth Co., and a relative reflection density was measured by setting the reflection density of a paper sheet to "0".

(Evaluation of Transfer Memory)

The transfer condition of the foregoing full color complex copier bizhub PRO C6500 was changed to each of 20 μA, 30 μA and 40 μA to continuously print 10 images each in which solid black and solid white were mixed, followed by further printing even half tone images. Generation or no generation of the memory was determined by whether the history of the foregoing solid black and white black appeared in the half tone image (generation of the memory) or not (no generation of the memory).

A: No generation of the memory has appeared. (Excellent)

B: Generation of the memory has appeared, but falls within the practically available range. (Practically acceptable)

C: Generation of the memory has largely appeared, and falls outside the practically available range. (Practically unacceptable)

Results of the above-described evaluation are shown in Table 2.

TABLE 2

| Photoreceptor No. | 405 nm Sensitivity E½ (μJ/cm²) | Repetitive property ΔVd | Repetitive property ΔVi | Potential stability Initial Vi | Potential stability Light-induced fatigue Vi | Image evaluation Initial One dot line | Image evaluation Initial Two dots line | Image evaluation Light-induced fatigue One dot line | Image evaluation Light-induced fatigue Two dots line | Image evaluation Transfer memory |
|---|---|---|---|---|---|---|---|---|---|---|
| 1 | 1.05 | −15 | 15 | 85 | 85 | A | A | B | B | A |
| 2 | 1.15 | −15 | 15 | 85 | 85 | A | A | B | B | A |
| 3 | 1.32 | −15 | 15 | 90 | 95 | B | A | B | B | A |
| 4 | 1.36 | −15 | 15 | 90 | 95 | B | A | B | B | A |
| 5 | 1.03 | −10 | 10 | 80 | 80 | A | A | A | A | A |
| 6 | 1.10 | −10 | 10 | 80 | 80 | A | A | A | A | A |
| 7 | 1.31 | −10 | 15 | 85 | 85 | A | A | A | A | A |
| 8 | 1.35 | −10 | 15 | 90 | 90 | A | A | A | A | A |
| 9 | 1.98 | −25 | 40 | 100 | 200 | C | B | C | C | C |
| 10 | 2.01 | −30 | 50 | 110 | 210 | C | B | C | C | C |

As is clear from Table 2, each of photoreceptor 1-8 possessing a compound represented by Formula (1) or Formula (2) as a charge transport material exhibits excellent sensitivity, repetitive property and potential stability with respect to exposure to light having a wavelength 400-500 nm such as laser light having a short wavelength or the like in addition to excellent reproduction of one dot line as well as two dots line also in the image evaluation employing laser light having a short wavelength of 450 nm and excellent stability in image reproduction, in comparison to photoreceptor 9 and photoreceptor 10 as comparative examples.

Photoreceptor 9 possessing charge transport material CTM-R1 (comparative charge transport material) exhibits comparatively good repetitive property and potential stability, but exhibits inferior sensitivity at a wavelength of 405 nm to that of each of photoreceptors 1-8, together with degradation in reproduction of one dot line in the image evaluation and degradation in evaluation of the transfer memory.

Photoreceptor 10 possessing charge transport material CTM-R2 (comparative charge transport material) exhibits inferior sensitivity, repetitive property and potential stability to those of each of photoreceptors 1-8, together with degradation in reproduction of one dot line in the image evaluation and generation largely in transfer memory.

EFFECT OF THE INVENTION

In the present invention, provided can be an electrophotographic photoreceptor exhibiting not only excellent durability together with high sensitivity but also excellent image reproduction, which is suitable for an image forming method by which imagewise exposure is performed employing a short wavelength semiconductor laser having an emission wavelength peak being in the range of 350-500 μm to form a high density electrostatic latent image on a photoreceptor, and also provided can be an image forming method employing the electrophotographic photoreceptor, and an image forming apparatus thereof.

What is claimed is:

1. An electrophotographic photoreceptor comprising a conductive support and provided thereon, a charge generation layer and a charge transport layer, wherein the charge generation layer comprises a pyranthrone pigment, and the charge transport layer comprises at least one of compounds represented the following Formula (1) or Formula (2):

Formula (1)

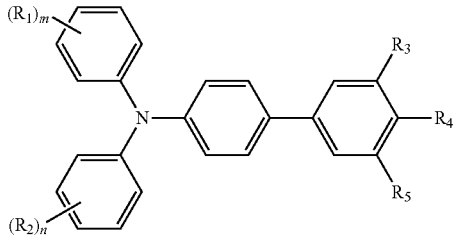

wherein each of $R_1$ and $R_2$ represents an alkyl group having 1-5 carbon atoms, an alkoxy group having 1-5 carbon atoms, or a halogen atom; each of m and n represents an integer of 0-5; and each of $R_3$-$R_5$ represents a hydrogen atom, an alkyl group having 1-5 carbon atoms, or an alkoxy group having 1-5 carbon atoms, provided that there is no case for all of $R_3$-$R_5$ being hydrogen atoms, Formula (2)

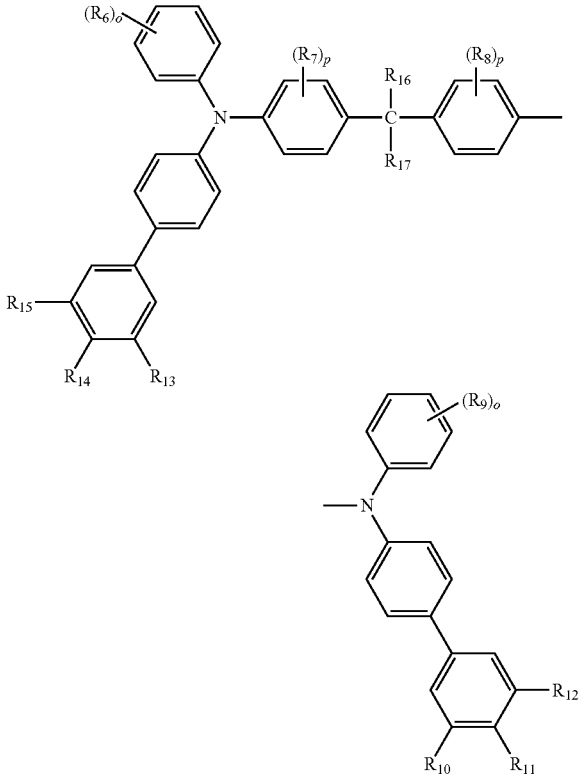

wherein each of $R_6$-$R_9$ represents an alkyl group having 1-5 carbon atoms, an alkoxy group having 1-5 carbon atoms, a halogen atom, an aryl group, a cyano group, a nitro group, or a hydroxyl group; o represents an integer of 0-5 and p represents an integer of 0-4, provided that there is no case for both and p being 0; each of $R_{10}$-$R_{15}$ represents a hydrogen atom, an alkyl group or alkoxy group having 1-5 carbon atoms, a halogen atom, an aryl group, a cyano group, a nitro group, or a hydroxyl group, provided that there is no case for all of $R_{10}$-$R_{15}$ being hydrogen atoms; each of $R_{16}$ and $R_{17}$ represents an alkyl group or an aryl group; and $R_{16}$ and $R_{17}$ may be bonded to form a cyclic structure.

2. The electrophotographic photoreceptor of claim 1, wherein the pyranthrone pigment comprises a compound represented by the following Formula (3):

Formula (3)

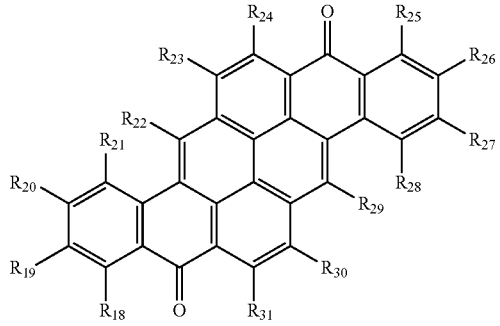

wherein each of $R_{18}$-$R_{31}$ represents a hydrogen atom, an alkyl group, an alkoxy group, an aryl group, a halogen atom, a cyano group, or a nitro group; and at least two selected from the group consisting of $R_{18}$-$R_{21}$ and $R_{25}$-$R_{28}$ may be bonded to constitute at least one of an aromatic ring and a heterocycle.

3. The electrophotographic photoreceptor of claim 2, wherein at least one of $R_{18}$, $R_{19}$, $R_{20}$, $R_{21}$, $R_{25}$ and $R_{28}$ represents a halogen atom.

4. The electrophotographic photoreceptor of claim 3, wherein each of $R_{18}$, $R_{21}$, $R_{25}$ and $R_{28}$ represents a halogen atom.

5. An image forming method to form images repeatedly employing an electrophotographic photoreceptor, comprising:

a charging seep of charging the electrophotographic photoreceptor;

a light exposure step of exposing the electrophotographic photoreceptor to light from a light source having an emission wavelength peak being in a range of 350-500 nm to form an electrostatic latent image; and a developinq step of developing the electrostatic latent image, wherein the electrophotographic photoreceptor comprises an electrophotographic photoreceptor of claim 2.

6. An image forming apparatus comprising a charging device to charge an electrophotographic photoreceptor;

a light exposure device to expose the electrophotographic photoreceptor to from a light source having an emission wavelength peak being in a range of 350-500 nm in order to form an electrostatic latent image; and a developing device to develop the electrostatic latent image, provided around the electrophotographic photoreceptor, wherein the electrophotographic photoreceptor comprises an electrophotographic photoreceptor of claim 2.

7. The electrophotographic photoreceptor of claim 1, wherein $R_4$ represents an alkyl group, and at least one of $R_{11}$ and $R_{14}$ represents an alkyl group.

8. An image forming method to form images repeatedly employing an electrophotographic photoreceptor, comprising:

a charging step of charging the electrophotographic photoreceptor;

a light exposure step of exposing the electrophotographic photoreceptor to light from a light source having an emission wavelength peak being in a range of 350-500 nm to form an electrostatic latent image; and a developing step of developing the electrostatic latent image, wherein the electrophotographic photoreceptor comprises an electrophotographic photoreceptor of claim 1.

9. An image forming apparatus comprising:

a charging device to charge an electrophotographic photoreceptor;

a light exposure device to expose the electrophotographic photoreceptor to light from a light source having an emission wavelength peak being in a range of 350-500 nm in order to form an electrostatic latent image; and a developing device to develop the electrostatic latent image, provided around the electrophotographic photoreceptor, wherein the electrophotographic photoreceptor comprises an electrophotographic photoreceptor of claim 1.

10. The electrophotographic photoreceptor of claim 1, wherein each of $R_3$ and $R_5$ represents a hydrogen atom, and $R_4$ represents an alkyl group.

11. An electrophotographic photoreceptor comprising a conductive support and provided thereon, a charge generation layer and, a charge transport layer, wherein the charge generation layer comprises a pyranthrone pigment, and the charge transport layer comprises at least one of compounds represented by the following Formula (2):

Formula (2)

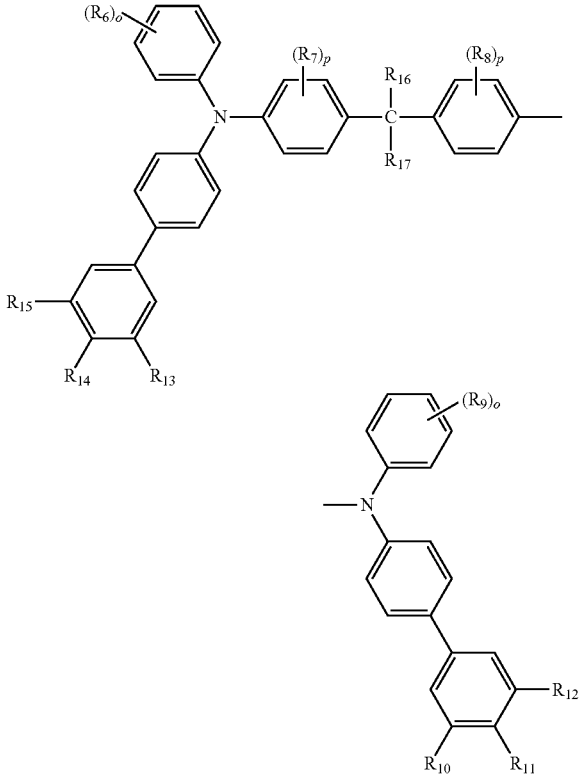

wherein each of $R_6$-$R_9$ represents an alkyl group having 1-5 carbon atoms, an alkoxy group having 1-5 carbon atoms, a halogen atom, an aryl group, a cyano group, a nitro group, or a hydroxyl group; o represents an integer of 0-5 and p represents an integer of 0-4, provided that there is no case for both and o being 0; each of $R_{10}$-$R_{15}$, represents a hydrogen atom, an alkyl group or alkoxy group having 1-5 carbon atoms, a halogen atom, an aryl group, a cyano group, a nitro group, or a hydroxyl group, provided that there is no case for all of $R_{10}$-$R_{15}$ being hydrogen atoms; each of $R_{16}$ and $R_{17}$ represents an alkyl group or an aryl group; and $R_{16}$ and $R_{17}$ may be bonded to form a cyclic structure.

12. The electrophotographic photoreceptor of claim 11, wherein the pyranthrone pigment comprises a compound represented by the following Formula (3):

Formula (3)

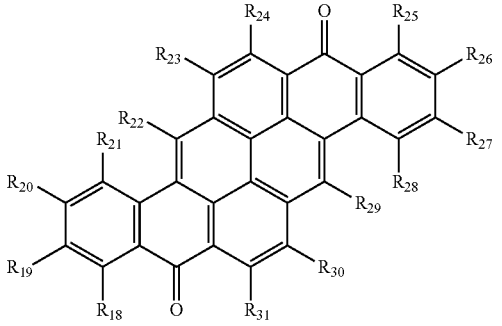

wherein each of $R_{19}$-$R_{31}$ represents a hydrogen atom, an alkyl group, an alkoxy group, an an group, a halogen atom, a cyano group, or a nitro group; and at least two selected from the group consisting of $R_{18}$-$R_{21}$ and $R_{25}$-$R_{28}$ may be bonded to constitute at least one of an aromatic ring and a heterocycle.

13. The eleotrophotographic photoreceptor of claim 12, wherein at least one of $R_{18}$, $R_{19}$, $R_{20}$, $R_{21}$, $R_{21}$, $R_{25}$ and $R_{28}$ represents a halogen atom.

14. The electrophotographic photoreceptor of claim 13, wherein each of $R_{18}$, $R_{21}$, $R_{25}$ and $R_{28}$ represents a halogen atom.

15. An image forming method to form images repeatedly employing an electrophotographic photoreceptor, comprising:

a charging step of charging the electrophotographic photoreceptor;

a light exposure step of exposing the electrophotographic photoreceptor to light from a light source having an emission wavelength peak being in a range of 350-500 nm to form, an electrostatic latent image; and a developing step of developing the electrostatic latent image, wherein the electrophotographic photoreceptor comprises an electrophotographic photoreceptor of claim 12.

16. An image forming apparatus comprising:

a charging device to charge an electrophotographic photoreceptor;

a light exposure device to expose the electrophotographic photoreceptor to light from a light source having an emission wavelength peak being in a range of 350-500 nm in order to form an electrostatic latent image; and a developing device to develop the electrostatic latent image, provided around the electrophotographic photoreceptor, wherein the electrophotographic photoreceptor comprises an electrophotographic photoreceptor of claim 12.

17. The electrophotographic photoreceptor of claim 11, wherein $R_4$ represents an alkyl group, and at least one of $R_{11}$ and $R_{14}$ represents an alkyl group.

18. An image forming method to form images repeatedly employing an electrophotographic photoreceptor, comprising:

a charging step of charging the electrophotographic photoreceptor;

a light exposure step of exposing the electrophotographic photoreceptor to light from a light source having an emission wavelength peak being in a range of 350-500 nm to form an electrostatic latent image; and a developing step of developing the electrostatic latent image, wherein the electrophotographic photoreceptor comprises an electrophotographic photoreceptor of claim 11.

19. An image forming apparatus comprising:

a charging device to charge an electrophotographic photoreceptor;

a light exposure device to expose the electrophotographic photoreceptor to light from a light source having an emission wavelength peak being in a range of 350-500 nm in order to form an electrostatic latent image; and a developing device to develop the electrostatic latent image, provided around the electrophotographic photoreceptor, wherein the electrophotographic photoreceptor comprises an electrophotographic photoreceptor of claim 11.

* * * * *